United States Patent [19]

Ellis et al.

[11] Patent Number: 4,489,532

[45] Date of Patent: Dec. 25, 1984

[54] ALUMINUM SHINGLE ACCESSORIES

[76] Inventors: Billy H. Ellis, No. 4 Edgehill Rd., Joshua, Tex. 76058; Randall Ellis, 7505 Ridgeway, Fort Worth, Tex. 76180

[21] Appl. No.: 493,153

[22] Filed: May 10, 1983

Related U.S. Application Data

[62] Division of Ser. No. 260,001, May 4, 1981, Pat. No. 4,411,120.

[51] Int. Cl.[3] ..... E04D 1/00

[52] U.S. Cl. ..... 52/748; 52/13; 52/276

[58] Field of Search ..... 52/748, 13, 14, 15, 52/276

[56] References Cited

U.S. PATENT DOCUMENTS

| | | | |
|---|---|---|---|
| 373,129 | 11/1887 | Carroll | 52/13 |
| 403,750 | 5/1889 | Hamsley | 52/13 |
| 409,387 | 8/1889 | Brown | 52/13 |
| 607,425 | 7/1898 | Drouré | 52/13 |
| 1,126,854 | 2/1915 | Peterson | 52/15 |
| 1,439,434 | 12/1922 | Manro | 52/13 |
| 2,258,078 | 10/1941 | Tennison | 52/13 |
| 3,352,649 | 11/1967 | Tennison | 52/13 |

*Primary Examiner*—Henry E. Raduazo

*Attorney, Agent, or Firm*—James E. Bradley

[57] ABSTRACT

Accessories for use in installing metal shingles to a roof have convertability and simplicity features. One of the accessories can be used as a starter strip at the edge of the eaves. It can also be used as a gable strip at the end of the gables. This accessory has two flat portions formed transverse to each other with a channel located at the corner between the two sections. At the edge of the eaves, the channel is oriented on top of the decking for receiving the locking flange of a conventional metal shingle. At the edge of the gable, the channel is oriented vertically, next to the fascia board, for receiving a downwardly bent edge of a conventional shingle. The valley base consists of two flat portions with an upwardly facing channel located in the center. The channel receives downwardly turned edges of the adjoining shingles.

1 Claim, 5 Drawing Figures

ALUMINUM SHINGLE ACCESSORIES

CROSS REFERENCE TO RELATED APPLICATION

This is a division of application Ser. No. 260,001, filed May 4, 1981 and now U.S. Pat. No. 4,411,120.

BACKGROUND OF THE INVENTION

This invention relates in general to building roofs, and in particular to accessories for use in installing aluminum shingles.

One type of shingle is a thin metal member, formed in a configuration to give an outside appearance of a wood shingle. This aluminum shingle is attractive, long lasting, and fire resistant.

The aluminum shingle concerned herein has a lower edge that curves around, resulting in a lower flange. This lower flange interlocks with a slot formed in the next upper shingle. The shingles are installed by working upward, each row interlocking with the row of shingles located immediately below. When starting at the eaves, special treatment must be provided. First, there must be a drip piece to reduce water running over the fascia board of the building. Also, a slot must be provided for the flange of the lowest shingle to interlock. Moreover, the slot must be spaced above the roof decking a selected distance so that the first or lowest row of shingles incline at the same angle as the other shingles, with respect to the roof decking.

Another area of special treatment is at the gable ends. This is the point at which the rows of shingles terminate. A drip edge must be provided at this point, and some sort of means is needed to terminate the shingles so that water will not run underneath the shingles. A third area of special treatment is the valley, if any, that is located between two sections of the roof. The valley needs a base that will allow the sides of the rows of shingles to be neatly terminated in a manner so as to be waterproof.

Accessories are available for accomplishing the three special treatments mentioned. It is desirable, however, to simplify the accessories, make them easier to install, and make the eave and gable end accessories interchangeable.

SUMMARY OF THE INVENTION

A new accessory is provided with this invention that can be used both as a starter strip and a gable strip. The accessory is a single strip of metal that has two flat portions formed at an angle with respect to each other. A channel is located at the intersection of the two flat portions. Both of the flat portions have outwardly turned drip edges. When the accessory is used as a starter strip, one flat portion extends over the fascia board, and another extends over the roof decking. The channel extends parallel to the roof decking for receiving the lower projecting flanges of the first row of shingles. When used as a gable strip, the flat portions are reversed. In this case, the channel extends downwardly, parallel with the fascia board. The side edges of the rows of shingles are bent downwardly and forced into the channel.

The valley base has two flat portions for securing to the roof decking on opposite sides of the center of the valley. An upwardly facing channel is formed between the two flat portions. The side edges of the shingles are bent downwardly at the valley and pressed into the channel.

DESCRIPTION OF THE PREFERRED EMBODIMENTS

Figure 1:
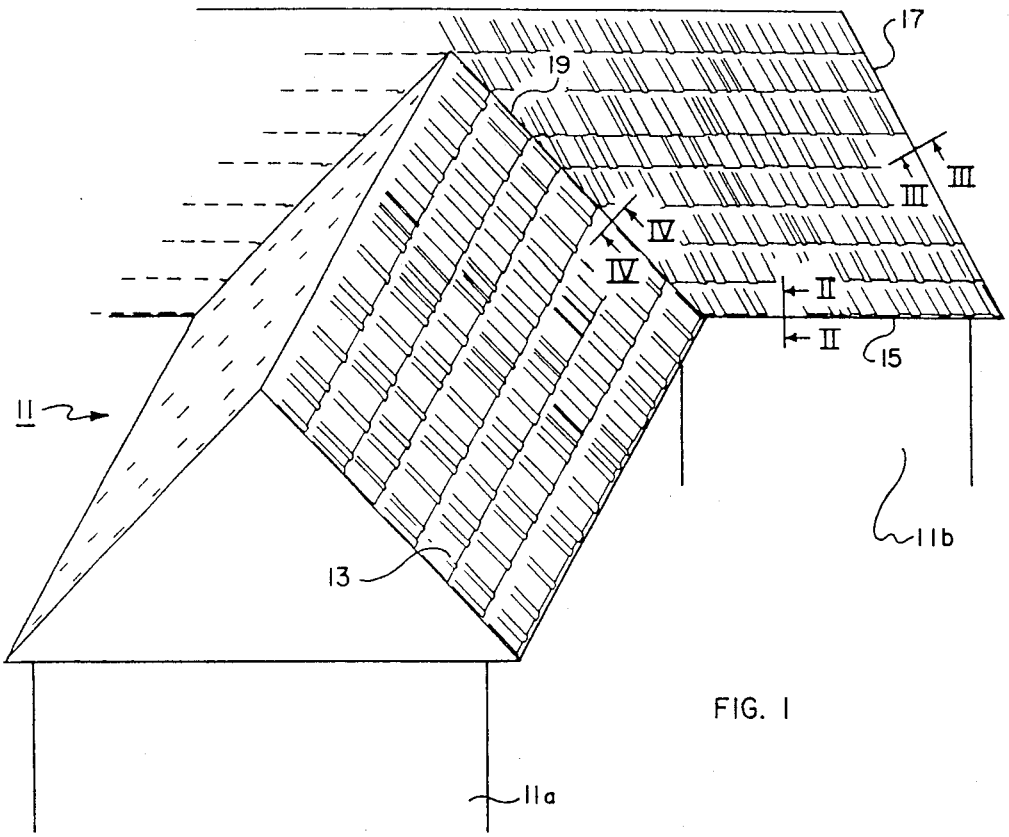
FIG. 1 is a perspective view illustrating portions of a building having aluminum shingles installed in accordance with this invention.

Referring to FIG. 1, a building 11 is schematically shown. Building 11 has a roof of metal shingles 13. The roof includes eaves 15 that overhang the vertical portion of the building. The roof also includes a gable end 17. Gable end 17 is a triangular, or peaked portion of the roof. The eaves 15 are the lowest portion of the sloping sides of the roof. The gable end 17 is the lateral end of the roof, and normally is contained within a vertical plane. Building 11 has two separate sections 11*a* and 11*b* that are joined to each other. A valley 19 is located at the junction of the roofs of the two sections 11*a* and 11*b*.

Figure 2B:
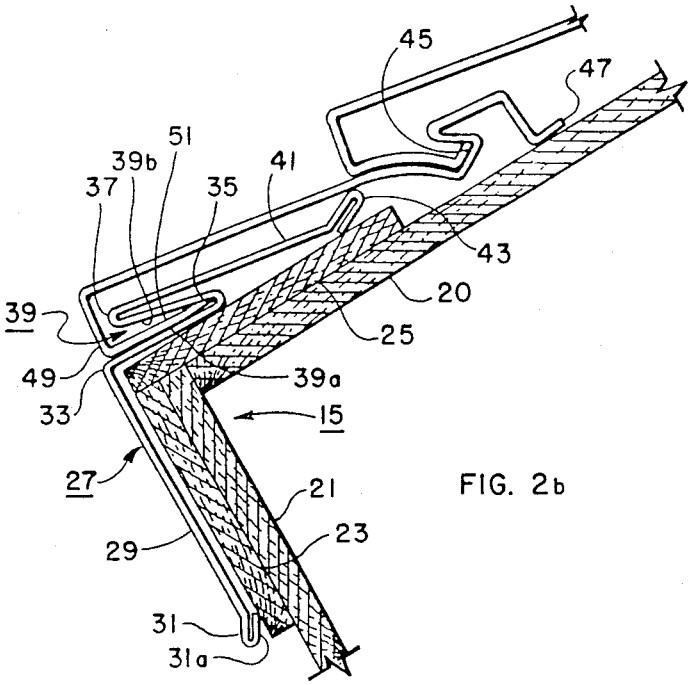
FIG. 2*b* is a vertical sectional view of the roof of FIG. 1, taken along the line II—II, with the shingles shown in place.
Figure 2A:
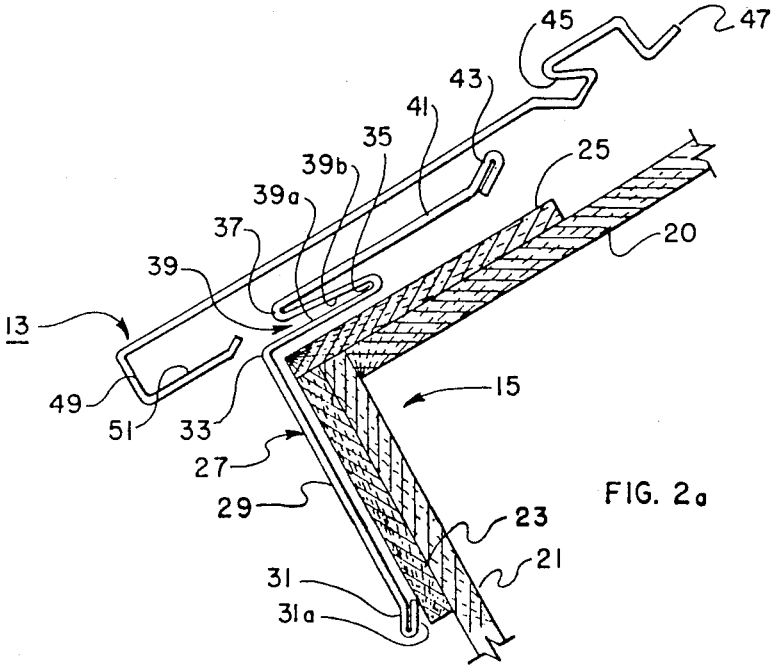
FIG. 2*a* is a vertical sectional view, exploded, of the roof of FIG. 1, taken along the line II—II.

FIG. 2*a* is an exploded sectional view of part of an eave 15. Roof decking 20, such as plywood, is located at the base of the roof and defines the slope of the roof. Normally a fascia board 21 is secured to the lower edge of the roof and runs along the length of eave 15. Fascia board 21 may incline inwardly and downwardly, as shown in FIG. 1*a*, or it may be vertical. Normally a board member 23 is nailed to the outside of fascia board 21.

To install metal shingles 13 to the roof, one begins at the eaves 15. The first step in this method involves placing a spacer board 25 on top of decking 20 at the extreme lower edge of eave 15. Spacer board 25 runs parallel with eave 15 and is about 1 inch by 4 inch in cross-sectional dimension.

Next, an accessory piece 27 is installed as a starter strip. Accessory piece 27 is a single, metal piece that has been bent to a desired configuration. The accessory strip 27 has a first flat portion 29 with an outwardly turned drip edge 31 on its free edge. Drip edge 31 has a doubled-back portion 31*a* for reinforcement. On the other side of the flat portion 29, a corner 33 is formed. Corner 33 is normally formed at a right angle, but can be bent to an obtuse angle to accommodate roofs that have fascia boards 21 that lie in vertical planes.

On the other side of corner 33, accessory 27 is bent 180° to form an inner bight 35. The accessory 27 is bent again 180° at a selected distance from the inner bight 35 to form an outer bight 37. The inner and outer bights 35 and 37 define a channel 39 with two sides 39*a* and 39*b*. Channel side 39*a* is located between corner 33 and inner bight 35. Channel side 39*b* is located between inner bight 35 and outer bight 37. The length of channel side 39*b* is less than the side 39*a* by a selected amount, placing outer bight 37 slightly further upward than corner 33. Inner bight 35 is the base of channel 39, and corner 33 and outer bight 37 define the top edges of channel 39. The remaining portions of accessory 27 include a second flat portion 41 that is transverse to flat portion 29. A drip edge 43 turns outwardly at the free edge of flat portion 41. Drip edge 43 is also doubled-backed for reinforcement, similar to drip edge 31, and is parallel with drip edge 31. The distance from corner 33 to drip edge 43 is less than the distance from corner 33 to drip edge 31 by an amount equal to the thickness of spacer board 25.

As shown in FIG. 2*a*, accessory 27 is secured to the eave 15, normally by nails (not shown) passing through flat portion 29 into the board member 23. Flat portion 29 will be parallel with the board member 23, defining a drip edge strip. Flat portion 41 will extend upwardly along roof decking 20 and spacer board 25. The lower side 39*a* of channel 29 will be in contact with the upper side of spacer board 25. Flat portion 41, however, will be spaced slightly above spacer board 25. Channel 39 will extend upwardly along the roof decking 20 for installing the first row of shingles 13.

Referring to FIG. 2*a*, shingle 13 is a single piece of aluminum that has been bent into the configuration of a shingle. On its upper side, a slot 45 extends upwardly and forwardly. Slot 45 is located near the upper edge 47 of the shingle. The lower edge of shingle 13 is bent at two 90° angles to form an end portion 49 that is perpendicular to roof decking 20. A flange 51 extends forwardly from the end portion 49, terminating in a slightly upturned free edge. Flange 51 is perpendicular to the end portion 49. Shingle 13 is three or four feet long.

After the accessory strip 27 has been secured to eave 15, the first row of shingles 13 are inserted in place by pressing the flange 51 into the channel 39 of accessory 27. The upper edge 47 is secured to the decking 20 by nails. Once in place, as shown in FIG. 2*b*, end portion 49 of shingle 13 will be flush with the flat portion 29, due to the shorter length of channel side 39*b* than channel side 39*a*. The flat portion 41 will be deformed downwardly slightly, by contact with the shingle 13. The distance from roof decking 20 to the shingle interlocking channel 45 is the same distance as from roof decking 20 to the accessory channel 39. This is as a result of using the spacer board 25, the thickness of which is calculated to space the channel 39 above decking 20 by the same amount. Having the interlocking slots 39 and 45 at the same distance from roof decking 20 causes the first or lowest row of shingles to incline with respect to roof decking 20 at the same angle as the other rows of shingles.

Figure 3:
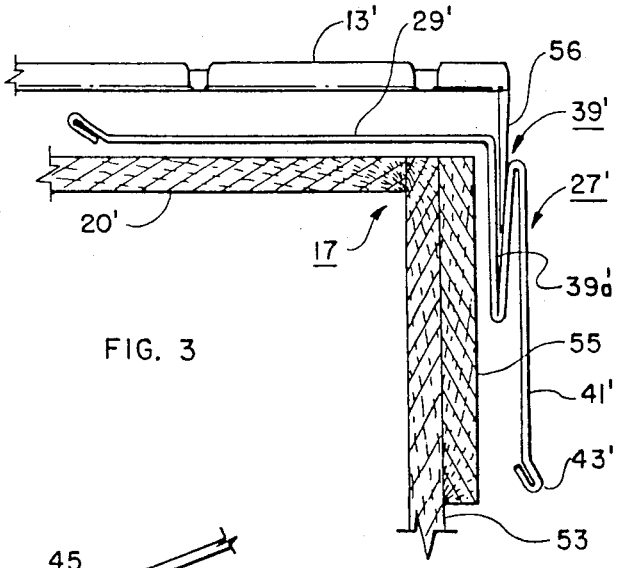
FIG. 3 is a vertical sectional view, exploded, of the roof of FIG. 1, taken along the line III—III of FIG. 1.

Referring to FIG. 3, the gable end 17 has a fascia board 53 that is vertical and perpendicular with respect to the roof decking 20'. Normally a board member 55 is nailed to the outside of the fascia board 53. To avoid confusion, the numerals in FIG. 3 concerning accessory 27 will be indicated with a prime symbol although the accessory strip is the same in FIGS. 2*a*, 2*b* and 3. When used as a gable strip, first flat portion 29' is nailed directly to roof decking 20', without any spacer elements such as spacer board 25. The outer side of channel side 29*a'* will be in contact and parallel with board member 55. Channel 39' will extend downwardly, parallel with the board member 55. The second flat portion 41' will extend downwardly, parallel with board 55, but spaced from board 55 by a distance equal to the width of channel 39'. The shingle 13 has its side edge 56 bent downwardly for insertion into channel 39.

In this position, the flat portion 41' serves as a drip edge portion. Since a spacer board, such as spacer 25, is not required on the gable end 17, the entire accessory 27' will be lower by the thickness of the spacer board 25 (FIG. 2) than the accessory 27 at the eaves 15. However, the distance from corner 33 to edge 43 is less than the distance from corner 33 to edge 31 by the thickness of spacer 25 (FIG. 2). This places the gable strip edge 43' (FIG. 3) at the same elevation as the drip edge 31*a* of the starter strip, (FIG. 2*a*) with respect to the roof decking.

Figure 4:
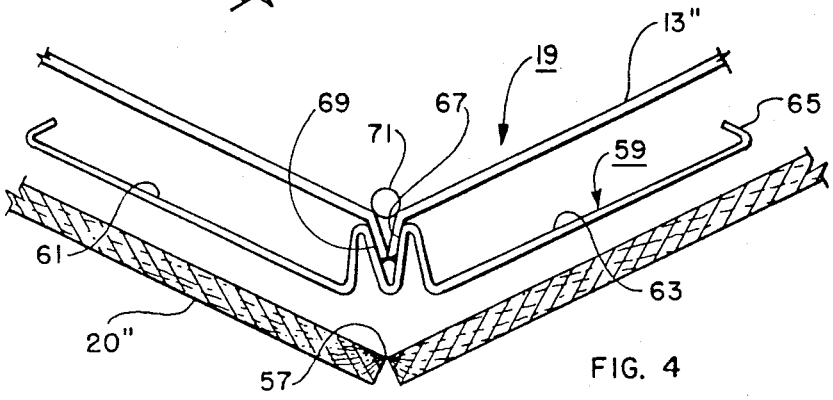
FIG. 4 is a vertical sectional view, exploded, of the roof of FIG. 1, taken along the line IV—IV.

Referring to FIG. 4, valley 19 has a center located at the intersection 57 of two sections of roof decking 20''. Normally, felt will be placed over the roof decking 20'' at the valley 19. A valley base 59 will be secured over the felt and the intersection 57. The valley base 59 includes two flat portions 61 and 63 that will be secured parallel and in contact with the roof decking portions 20'' on both sides of the intersection 57. Normally, each portion 61 and 63 will have an upwardly turned edge 65. An upwardly facing channel 67 is located in the center, in the same vertical plane as intersection 57. Channel 67 is in the general shape of an "M". The bottom of channel 67 would lie in a common plane with the flat portions 61 and 63 if the portions 61 and 63 were bent into a common plane. When flat portions 61 and 63 are bent into a obtuse angle as shown, the bottom of channel 67 will be spaced above the intersection of the planes containing flat portions 61 and 63. The rows of shingles 13'' are bent downwardly at their side edges 69 and inserted into channel 67 in contact with each other. A liquid sealant 71 is placed inside the junction of the side edges 69 to prevent leakage.

In operation, the roof is installed by initially placing a spacer board 25 around the eaves 15, as shown in FIGS. 1*a* and 2*b*. Then an accessory 27 is installed as a starter strip by locating the channel 39 on top of the spacer 25, as shown in FIG. 2*a*. Then, the first row of shingles 13 is installed by inserting the flange 51 into the channel 39 and nailing the shingle to the roof as shown in FIG. 2*b*. Further rows are installed in the same manner. At the gable ends 17, an accessory 27' is installed with its channel 39' facing downwardly, as shown in FIG. 33. Side edges 56 of the shingles are bent and inserted into the channel 39' to terminate at the gable. At the valleys, the valley base 59 is secured over the intersection 57 of the two sloping roof portions 20'', as shown in FIG. 4. Joining shingles 13'' are bent at their side edges 69 and inserted into the channel 67 of the valley base.

The invention has significant advantages. The accessory can be used both as a starter strip for eaves and as a gable strip. It is a single piece and easy to construct. The valley base is simple in construction and effective against leakage. Both the accessory and the valley base allow the shingles to be quickly and easily installed.

While the invention has been shown in only one of its forms, it should be apparent that it is not so limited but is susceptible to various changes and modifications without departing from the spirit of the invention.

I claim:

1. An improved method of installing metal shingles at a valley of a roof, comprising:

providing a metal valley base with two flat portions located at an obtuse angle with respect to each other and separated by an upwardly facing channel;

mounting the valley base over the valley, with the channel in the same vertical plane as the valley center;

bending the sides of adjoining shingles at the valley downwardly and inserting the sides into the channel in contact with each other; and securing the adjoining shingles to the roof and placing sealant into the junction of the adjoining shingles.

* * * * *